US008757032B2

(12) United States Patent
Shu-Ju

(10) Patent No.: US 8,757,032 B2
(45) Date of Patent: Jun. 24, 2014

(54) SHIFTING DEVICE FOR A WRENCH TOOL

(76) Inventor: Chen Shu-Ju, Taichung (TW)

( * ) Notice: Subject to any disclaimer, the term of this patent is extended or adjusted under 35 U.S.C. 154(b) by 228 days.

(21) Appl. No.: 13/555,904

(22) Filed: Jul. 23, 2012

(65) Prior Publication Data

US 2014/0020517 A1 Jan. 23, 2014

(51) Int. Cl.

*B25B 13/00* (2006.01)
*B25B 13/46* (2006.01)
*B25B 23/00* (2006.01)

(52) U.S. Cl.

CPC ..... *B25B 23/0028* (2013.01); *B25B 13/463* (2013.01)
USPC ..... 81/58.4; 81/177.8

(58) Field of Classification Search

USPC ..... 81/58, 58.1, 58.4, 58.5, 177.8, 177.9, 81/177.7
See application file for complete search history.

(56) References Cited

U.S. PATENT DOCUMENTS

| | | | | |
|---|---|---|---|---|
| 5,941,141 | A * | 8/1999 | Whitley | 81/63.1 |
| 6,216,565 | B1 * | 4/2001 | McCann | 81/177.8 |
| 6,752,048 | B1 * | 6/2004 | Chiang | 81/63.1 |
| 6,928,904 | B2 * | 8/2005 | Hsien | 81/60 |
| 6,993,998 | B1 * | 2/2006 | Kao et al. | 81/60 |
| 7,168,346 | B2 * | 1/2007 | Lin | 81/177.9 |
| 7,302,876 | B1 * | 12/2007 | Lee et al. | 81/177.9 |
| 7,415,911 | B2 * | 8/2008 | Cole et al. | 81/177.8 |
| 8,156,845 | B2 * | 4/2012 | Lin | 81/62 |
| 8,347,763 | B1 * | 1/2013 | Chu | 81/177.9 |
| 2005/0016332 | A1 * | 1/2005 | Hu | 81/177.8 |

* cited by examiner

*Primary Examiner* — David B Thomas

(57) ABSTRACT

A shifting device for a wrench tool contains: a tool head including a driving portion and an axial hole, and the axial hole having a plurality of inner teeth; a rotating rod including an axial peg extending outwardly to be fitted in the axial hole, and the axial peg including a first groove and a second groove communicating with the first groove; an engaging member received in the first groove and having a toothed section and a pushing section; a controlling member fixed in the second groove and having an abutting stem extending into the first groove, such that the controlling member pushes the pushing section so that the toothed section engages with the plurality of inner teeth; two elastic loops fitted on the axial peg of the rotating rod to push one end of the engaging member so that the engaging member moves back to an original position.

10 Claims, 12 Drawing Sheets

SHIFTING DEVICE FOR A WRENCH TOOL

FIELD OF THE INVENTION

The present invention relates to a shifting device for a wrench tool which allows being shifted to a rotary forcing mode so that the abutting stem of the controlling member directly pushes the engaging member to make the toothed section of the engaging member engage with the plurality of inner teeth of the tool head, such that the tool head is driven, and the axial peg is reinforced to enhance the service life of the shifting device.

BACKGROUND OF THE INVENTION

A conventional angular positioning structure of a rotary wrench 10 disclosed in TW Publication No. 542053 contains a driving portion 11, the driving portion 11 has an axial hole 111 with inner teeth 112, a grip 12 with an axial seat 121 to be fitted in the axial hole 111 so that the grip 12 allows rotation on the driving portion 11. The axial seat 121 has two grooves 122 defined on two sides thereof and a cavity 123 defined on a middle portion thereof to receive the angular positioning structure. The angular positioning structure contains two retaining blocks 13 axially connected in the two grooves 122 of the axial seat 121 by using two bolts 124, two recesses 131 defined on an inner face of each retaining block 13, an outer toothed section 132 defined on an outer face of one end of the each retaining block 13, and a plane 133 formed on another end of the each retaining block 13. The angular positioning structure also contains a switch 14 axially fixed in the cavity 123 of the axial seat 121, an actuation portion 141 mounted under the switch 14 and extending between the two retaining blocks 13, a resilient element 15 secured in the actuation portion 141, and two positioning tabs 16 abut against two ends of the resilient element 15, such that the resilient element 15 pushes the two positioning tabs 16 to engage with the two recesses 131, thus positioning the two retaining blocks 13. In addition, the cavity 123 of the grip 12 includes a pushing element 12 for abutting against the actuation portion 141 of the switch 14 such that the switch 14 is shifted at different positions. With reference to FIGS. 2 and 3, when a front end of the switch 14 is pressed, the actuation portion 141 drives the two positioning tabs 16 to retain in the two recesses 131 so that two outer toothed sections 132 of the two retaining blocks 13 move inward to disengage from the inner teeth 112 of the driving portion 11, thus shifting the rotary wrench 10 to a quick rotating mode. Referring to FIGS. 4 and 5, a rear end of the switch 12 is pressed so that the actuation portion 141 drives the two positioning tabs 16 to retain in the two recesses 131, hence the two outer toothed section 132 of the two retaining blocks 13 moves outward to engage with the inner teeth 112 of the driving portion 11, thus shifting the rotary wrench 10 to a rotary forcing mode. However, such a conventional rotary wrench 10 has the following defects:

1. As shifting the rotary wrench to the rotary forcing mode, the resilient element 15 pushes the two positioning tabs 16 to retain in the two recesses 131 so that the two outer toothed sections 132 of the two retaining blocks 13 move outward to engage with the inner teeth 112 of the driving portion 11, but the two positioning tabs 16 can not retain in the two recesses 131 securely, so when the user rotates the rotary wrench 10, a reaction force from the inner teeth 112 of the driving portion 11 causes the two retaining blocks 13 to move inward, and then the two outer toothed sections 132 of the two retaining blocks 13 disengage from the inner teeth 112 of the driving portion 11, the driving portion 11 can not be engaged completely.

2. The axial seat 121 has two grooves 122 to receive the two retaining blocks 13, yet the two grooves 122 decrease strength of the axial seat 121, thereby lowering the service life of the axial seat 121.

3. The axial seat 121 has two grooves 122 to axially connect the two retaining blocks 13 therein by using the two bolts 124, and the actuation portion 141 of the switch 14 has the resilient element 15 and the two positioning tabs 16, thus having many connecting parts to increase production cost.

The present invention has arisen to mitigate and/or obviate the afore-described disadvantages.

SUMMARY OF THE INVENTION

The primary object of the present invention is to provide a shifting device for a wrench tool which allows being shifted to a quick rotating mode so as to remove the bolt element rapidly and allows being shifted to a rotary forcing mode so that the abutting stem of the controlling member directly pushes the engaging member to make the toothed section of the engaging member engage with the plurality of inner teeth of the tool head, such that the tool head is driven.

Secondary object of the present invention is to provide a shifting device for a wrench tool in which the axial peg of the rotating rod only includes the first groove defined thereon to receive one single engaging member, such that the axial peg is reinforced to enhance the service life of the shifting device.

Another object of the present invention is to provide a shifting device for a wrench tool in which the axial peg of the rotating rod only includes the first groove defined thereon to receive one single engaging member, such that related connecting parts are simplified to lower production cost.

To obtain the above objective, shifting device for a wrench tool provided by the present invention contains:

a tool head including a driving portion defined on one end thereof and an axial hole defined on another end thereof, and the axial hole having a plurality of inner teeth defined around an inner surface thereof;

a rotating rod including an axial peg extending outwardly from one end thereof to be fitted in the axial hole of the tool head, and the axial peg including a first groove horizontally defined on a bottom end thereof and a second groove vertically formed on a top end thereof and communicating with the first groove;

an engaging member received in the first groove of the rotating rod and having a toothed section defined on one end thereof and a pushing section formed on another end thereof;

a controlling member fixed in the second groove of the rotating rod and having an abutting stem extending into the first groove, such that the controlling member pushes the pushing section of the engaging member so that the toothed section of the engaging member engages with the plurality of inner teeth of the tool head;

two elastic loops fitted on the axial peg of the rotating rod to push the one end of the engaging member so that the engaging member moves back to an original position.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
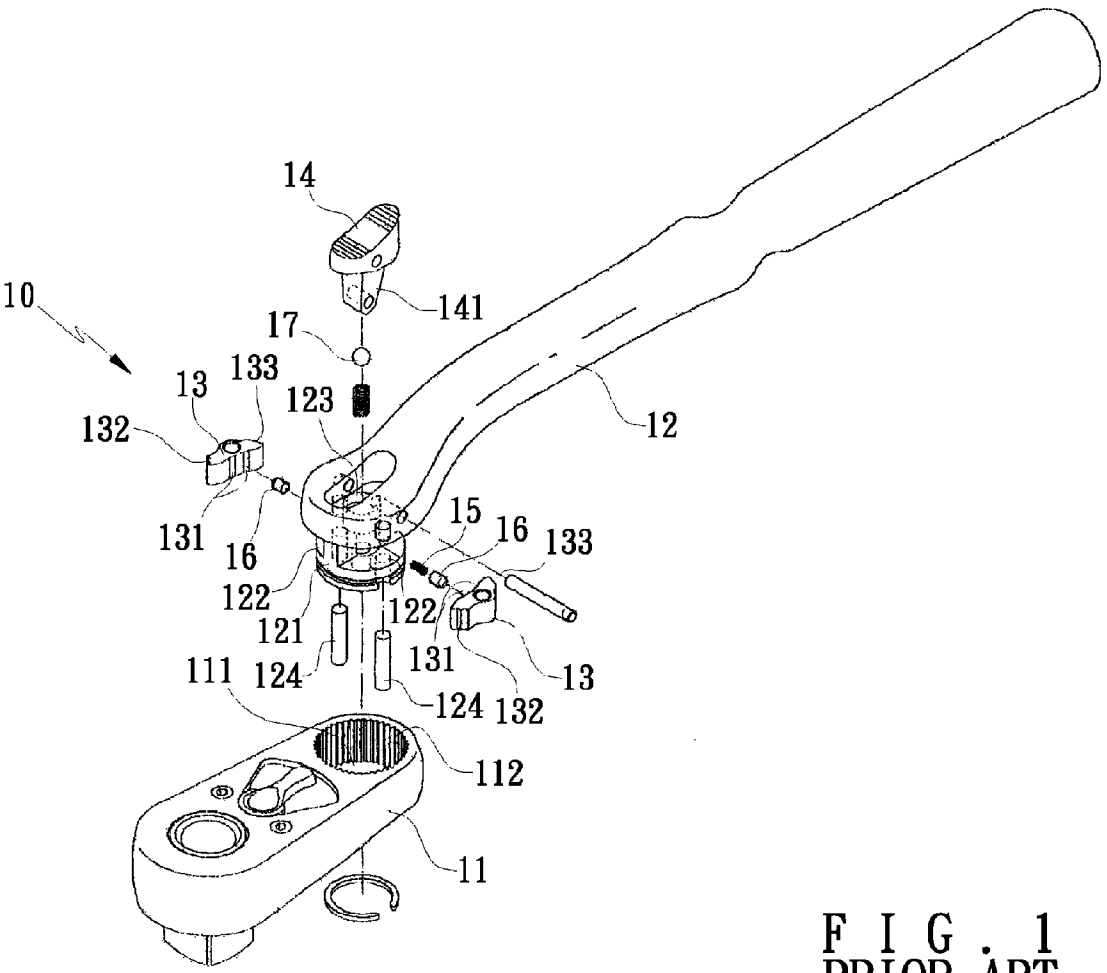
FIG. 1 PRIOR ART
FIG. 1 is a perspective view showing the exploded components of a conventional angular positioning structure of a rotary wrench disclosed in TW Publication No. 542053.
Figure 2:
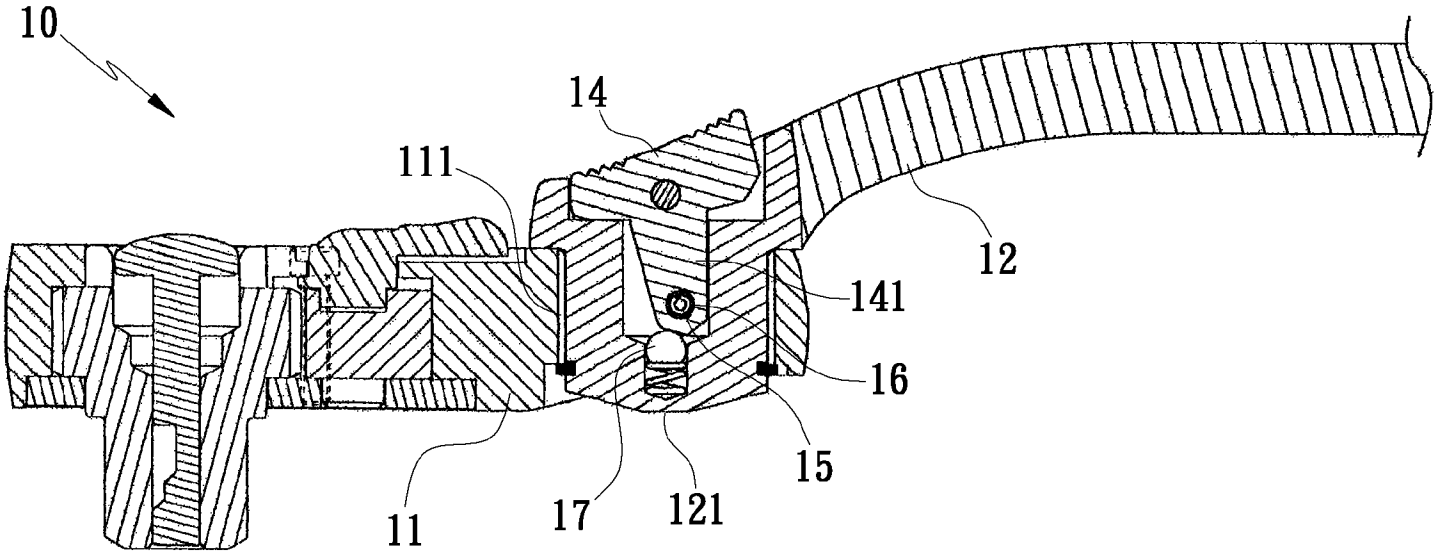
FIG. 2 PRIOR ART
FIG. 2 is a cross sectional view showing the operation of the conventional angular positioning structure of the rotary wrench disclosed in TW Publication No. 542053.
Figure 3:
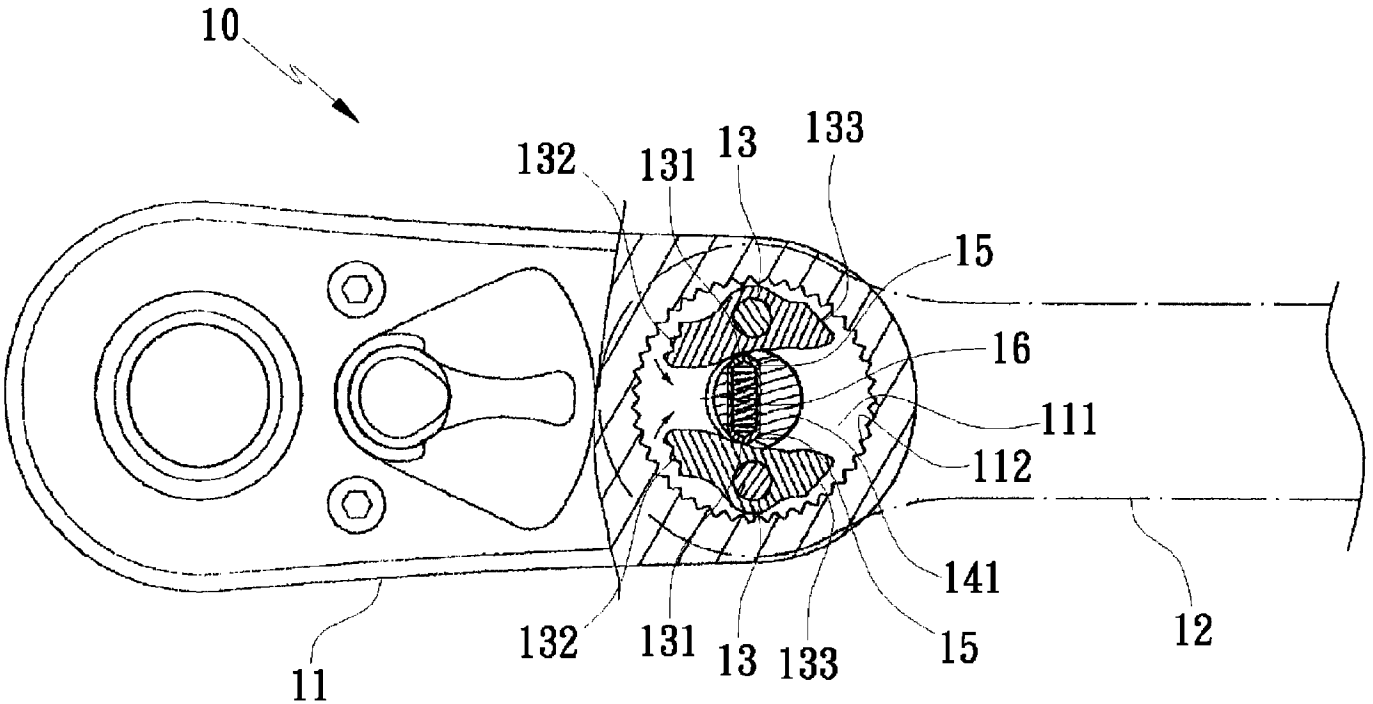
FIG. 3 PRIOR ART
FIG. 3 is another cross sectional view showing the operation of the conventional angular positioning structure of the rotary wrench disclosed in TW Publication No. 542053.
Figure 4:
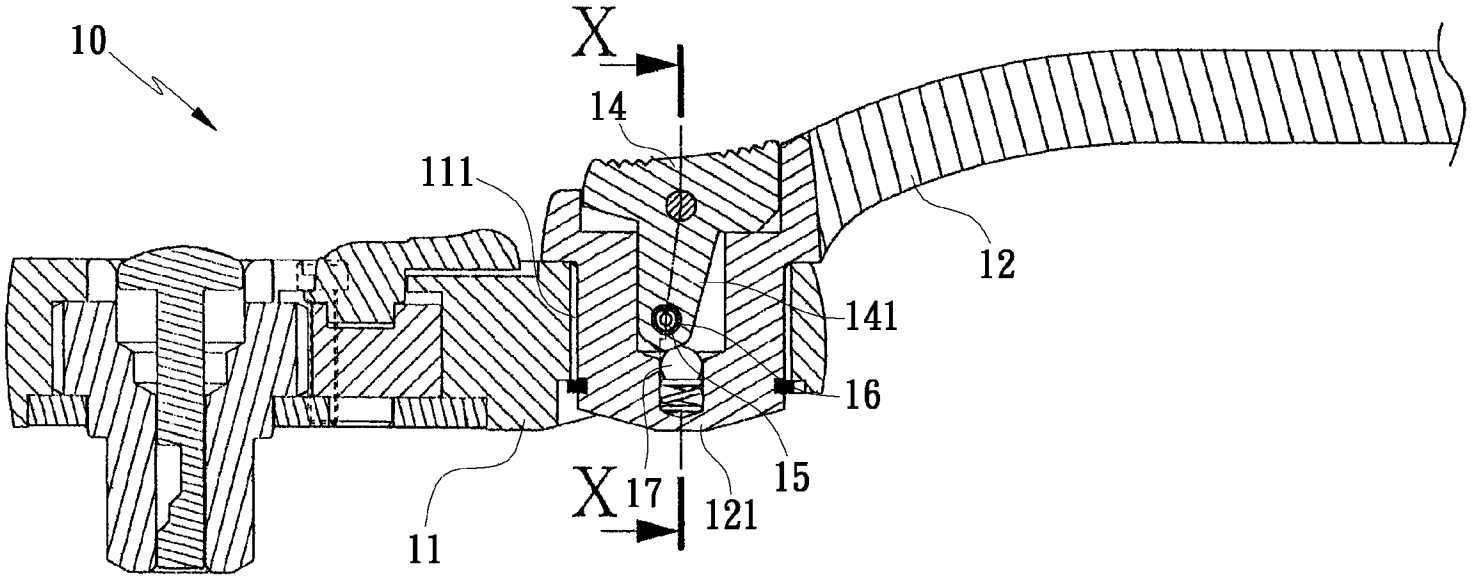
FIG. 4 PRIOR ART
FIG. 4 is also another cross sectional view showing the operation of the conventional angular positioning structure of the rotary wrench disclosed in TW Publication No. 542053.
Figure 5:
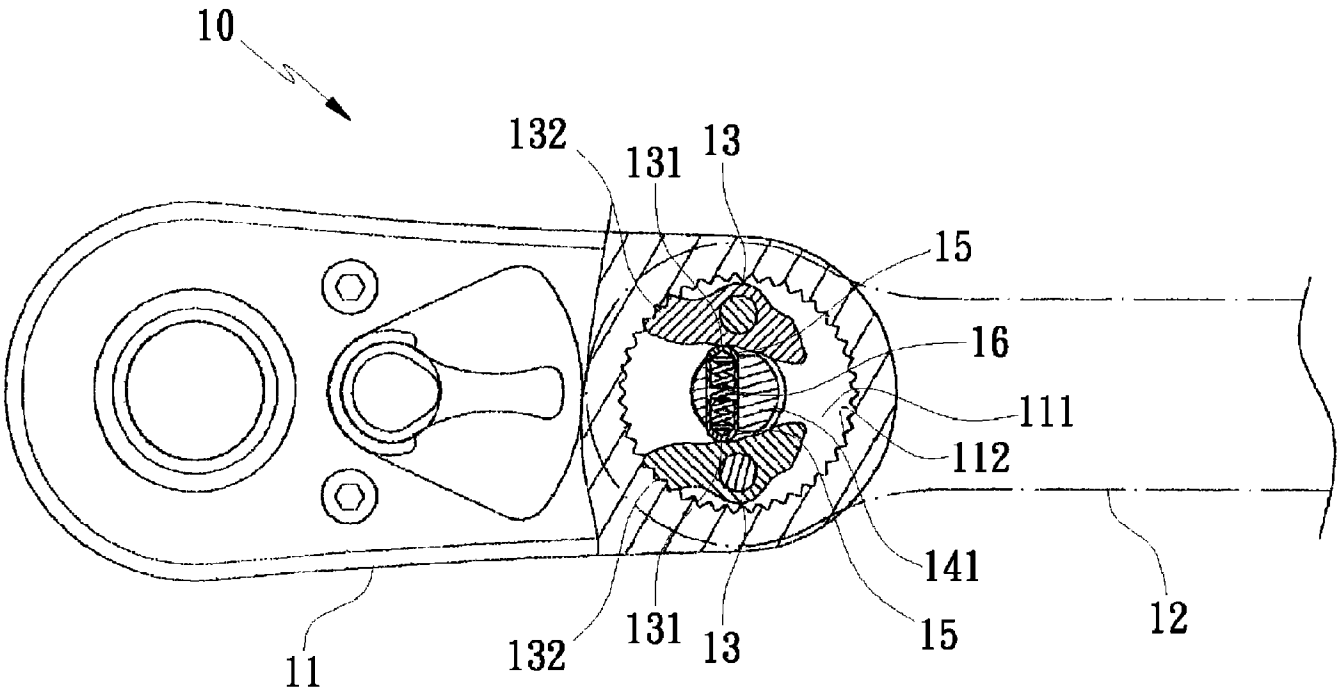
FIG. 5 PRIOR ART
FIG. 5 is still another cross sectional view showing the operation of the conventional angular positioning structure of the rotary wrench disclosed in TW Publication No. 542053.
Figure 6:
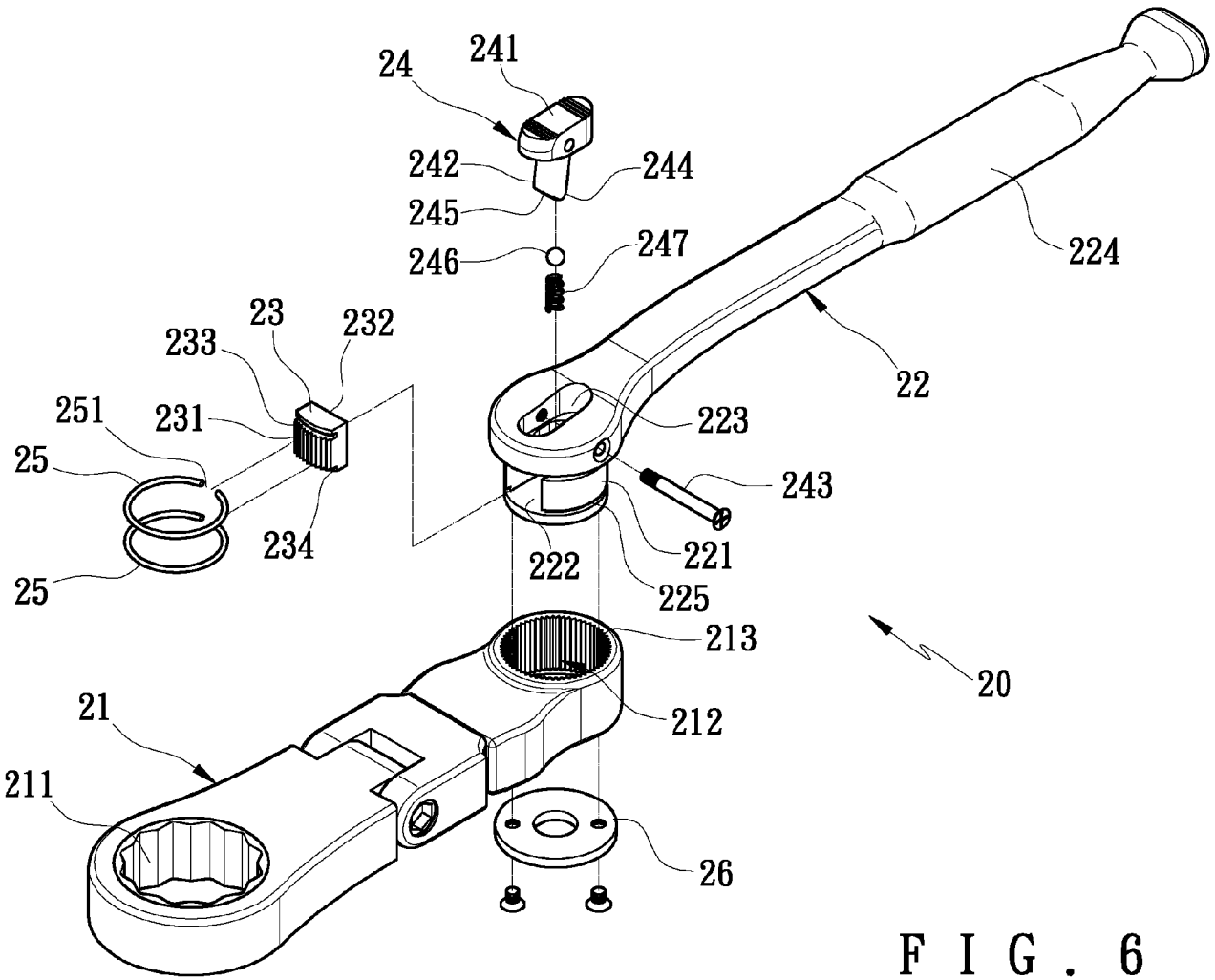
FIG. 6 is a perspective view showing the exploded components of a shifting device for a wrench tool according to a preferred embodiment of the present invention.
Figure 7:
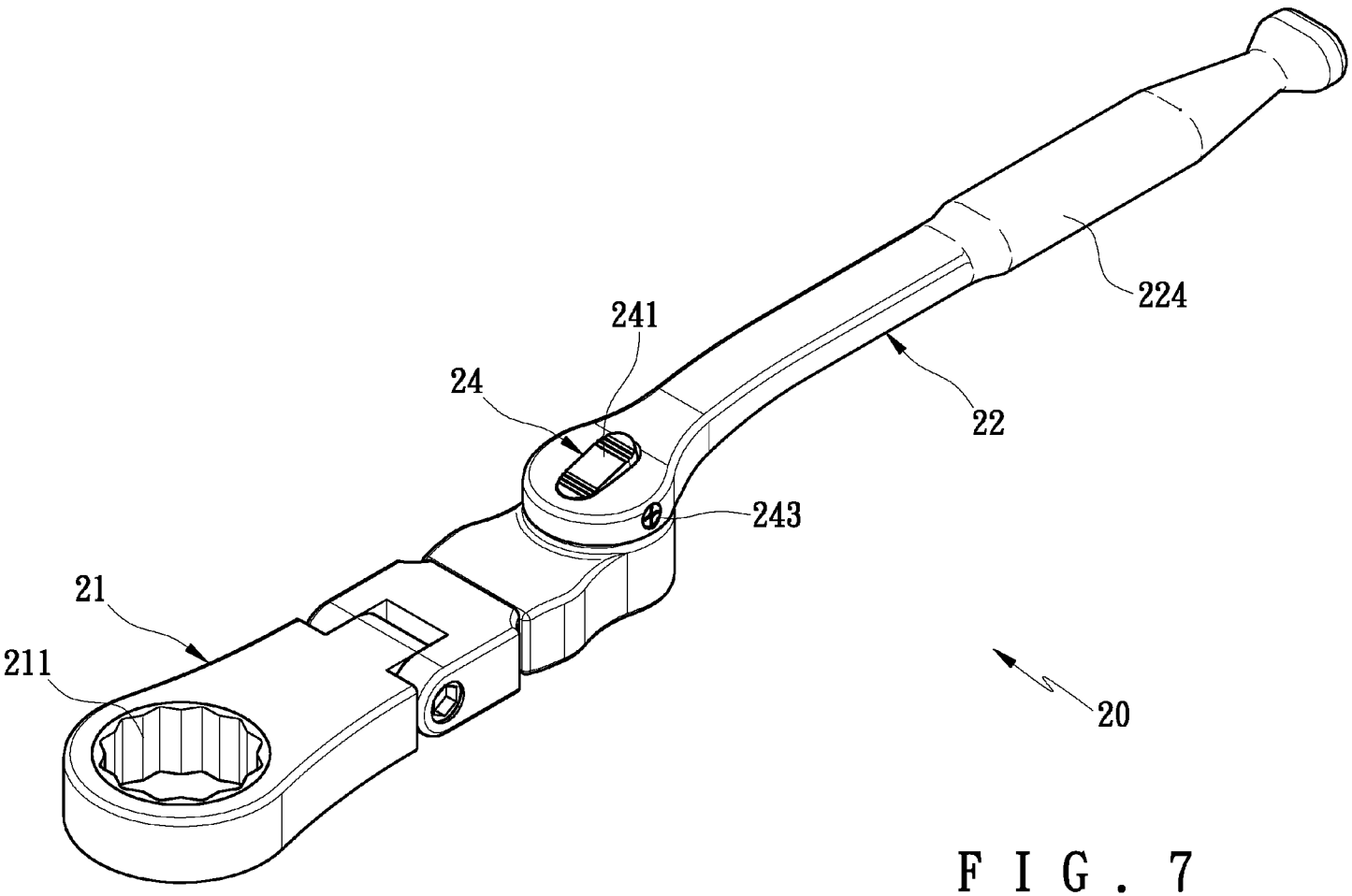
FIG. 7 is a perspective view showing the assembly of the shifting device for the wrench tool according to the preferred embodiment of the present invention.
Figure 8:
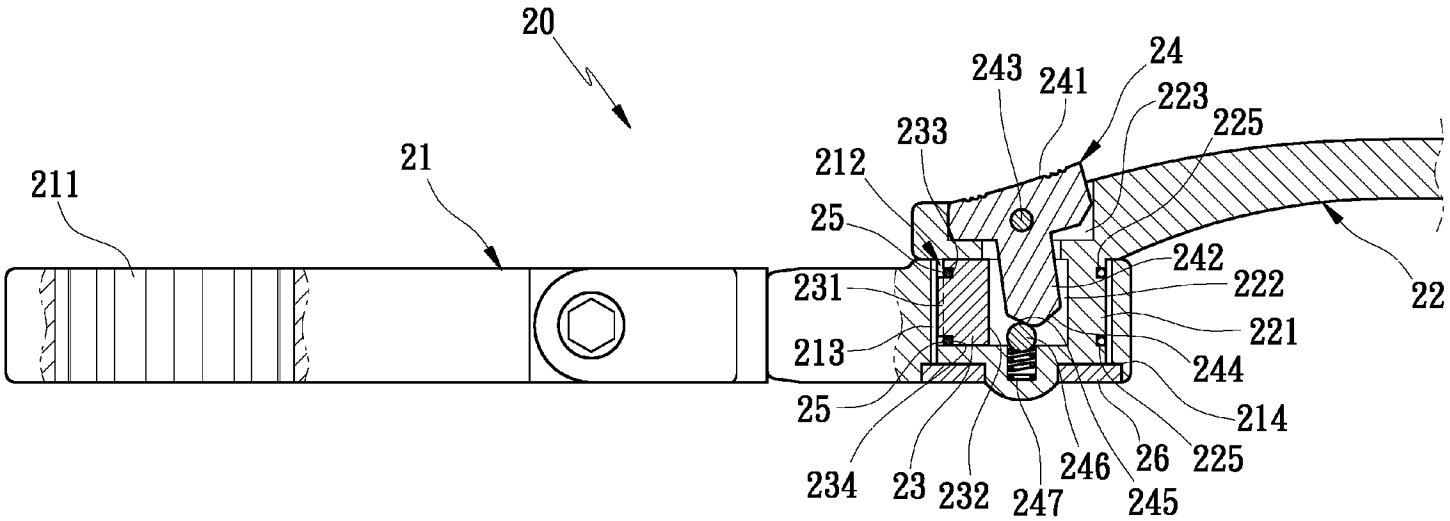
FIG. 8 is a cross sectional view showing the assembly of the shifting device for the wrench tool according to the preferred embodiment of the present invention.

FIGS. 6-8, a shifting device for a wrench tool 20 according to a preferred embodiment of the present invention comprises a tool head 21, a rotating rod 22, an engaging member 23, a controlling member 24, and two elastic loops 25. The tool head 21 includes a polygonal driving portion 211 (such as a polygonal orifice) defined on one end thereof to fit with a bolt element and an axial hole 212 defined on another end thereof, and the axial hole 212 has a plurality of inner teeth 213 defined around an inner surface thereof. The rotating rod 22 includes an axial peg 221 extending outwardly from one end thereof to be fitted in the axial hole 212 of the tool head 21, and between the axial hole 212 of the tool head 21 and the axial peg 221 of the rotating rod 22 is defined a limiting structure so that the axial peg 221 of the rotating rod 22 is limited in the axial hole 212 of the tool head 21. In this embodiment, the limiting structure contains a stepped slot 214 formed on an bottom end of the axial hole 212 of the tool head 21 and a stop ring 26 fixed on a bottom end of the axial peg 221 of the rotating rod 22 so that the stepped slot 214 of the tool head 21 stops the stop ring 26 to prevent the axial peg 221 from disengagement from the axial hole 212. The axial peg 221 includes a first groove 222 horizontally defined on a bottom end thereof and a second groove 223 vertically formed on a top end thereof and communicating with the first groove 222, and the rotating rod 22 includes a grip 224 arranged on another end thereof for being held by a user. The first groove 222 of the rotating rod 22 has an engaging member 23 received therein, and the engaging member 23 has a toothed section 231 defined on one end thereof and a pushing section 232 formed on another end thereof, the engaging member 23 moves reciprocatingly in the first groove 222 so that the toothed section 231 extends outside an peripheral surface of the axial peg 221 to engage with the plurality of inner teeth 213 of the tool head 21, and the toothed section 231 of the engaging member 23 allows moving inwardly to disengage from the inner teeth 213 of the tool head 21. The second groove 223 of the rotating rod 22 includes the controlling member 24 fixed therein, and the controlling member 24 has a switch 241 fixed on one end thereof and located at a top end of the second groove 223 and has an abutting stem 242 extending into the first groove 222 from another end of the controlling member 24, such that the switch 241 of the controlling member 24 controls the abutting stem 242 to move forwardly and to push the pushing section 232 of the engaging member 23 so that the toothed section 231 of the engaging member 23 engages with the inner teeth 213 of the tool head 21, and the switch 241 of the controlling member 24 allows controlling the abutting stem 242 to move back to an original position to further disengage from the pushing section 232 of the engaging member 23, hence the toothed section 231 of the engaging member 23 disengages from the inner teeth 213 of the tool head 21. In this embodiment, the controlling member 24 also has a pin 243 defined between the switch 241 and the abutting stem 242 and axially fixed in the second groove 223 such that the switch 241 drives the abutting stem 242 to move forward and backward along the pin 243 and to define a front shifting position and a rear shifting position of the controlling member 24 by ways of a positioning structure. In this embodiment, the positioning structure contains a first positioning portion 244 and a second positioning portion 245, both of which are defined on a bottom end of the abutting stem 242 of the controlling member 24, and the positioning structure also contains a biasing element 246 (such as a ball) and a resilient element 247 (such as a spring), both of which are mounted under the bottom end of the abutting stem 242, such that the resilient element 247 pushes the biasing element 246, and as the abutting stem 242 of the controlling member 24 is biased against the pushing section 232 of the engaging member 23, the biasing element 246 abuts against the first positioning portion 244 of the controlling member 24, and while the abutting stem 242 of the controlling member 24 disengages from the pushing section 232 of the engaging member 23, the biasing element 246 abuts against the second positioning portion 245 of the controlling member 24. In addition, the axial peg 221 of the rotating rod 22 has the two elastic loops 25 fitted thereon, and the one end of the engaging member 23 contacts with an inner rim of each elastic loop 25 on which an opening 251 is defined so that the each elastic loop 25 expands and retracts elastically, when the abutting stem 242 of the controlling member 24 pushes the pushing section 232 of the engaging member 23, the one end of the engaging member 23 pushes the two elastic loops 25 forwardly so that the two elastic loops 25 expend outwardly, and while the abutting stem 242 of the controlling member 24 disengages form the pushing section 232 of the engaging member 23, the two elastic loops 25 push the one end of the engaging member 23 so that the engaging member 23 moves back to its original position. In this embodiment, the axial peg 221 of the rotating rod 22 includes two notches 225 defined thereon and located at an upper rim and a lower rim of the first groove 222 so as to fit the two elastic loops 25, and the engaging member 23 also includes two contacting indentations 233, 234 formed on the one end thereof to contact with the two elastic loops 25.

Figure 9:
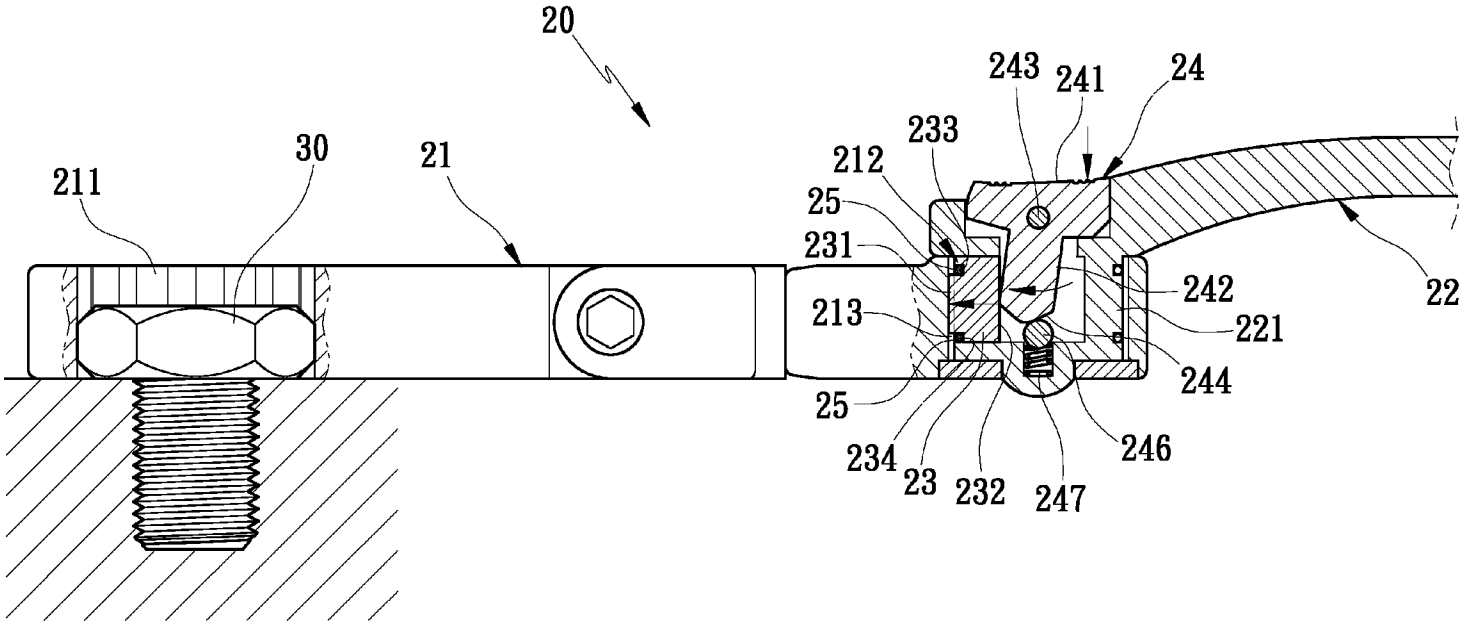
FIG. 9 is a cross sectional view showing the shifting device of the present invention is operated in a rotary forcing mode.
Figure 10:
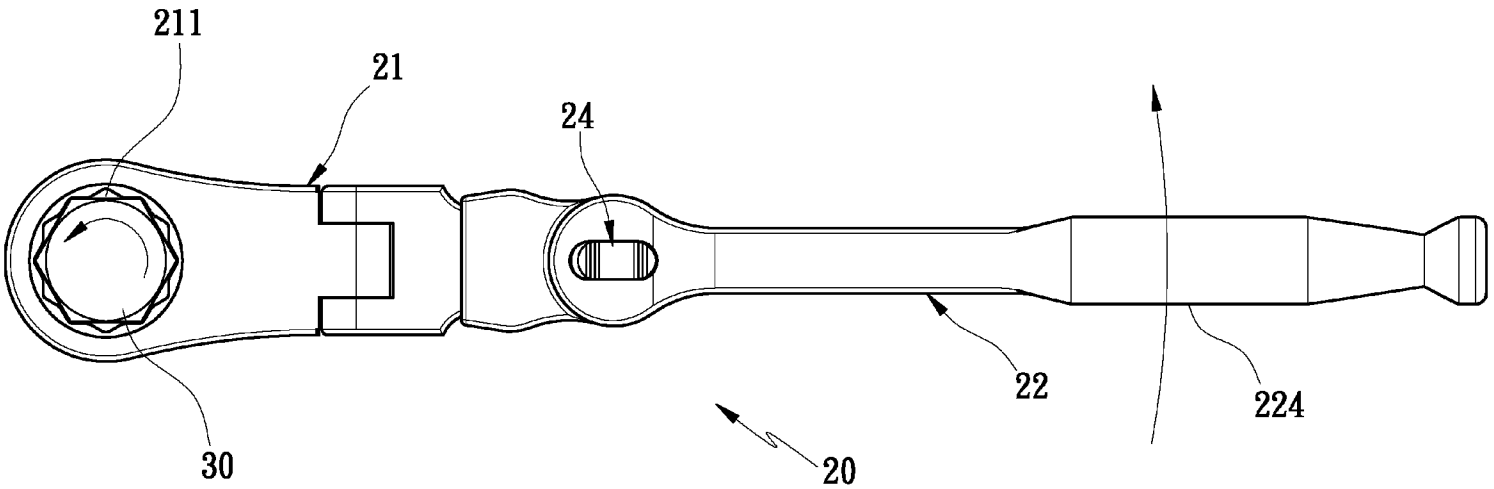
FIG. 10 is a top plan view showing the shifting device of the present invention is operated in the rotary forcing mode as well.

As shown in FIGS. 9 and 10, when the wrench tool 20 is used to remove the bolt element 30, the driving portion 211 of the tool head 21 is fitted with the bolt element 30, and the wrench tool 20 is shifted to a rotary forcing mode by pressing a rear end of the switch 241 of the controlling member 24 so that the abutting stem 242 of the controlling member 24 moves forwardly, and the abutting stem 242 of the controlling member 24 pushes the pushing section 232 of the engaging member 23 so that the toothed section 231 of the engaging member 23 extends outside the axial peg 221 of the rotating rod 22 to engage with the plurality of inner teeth 213 of the tool head 21, and the biasing element 246 abuts against the first positioning portion 244 of the controlling member 24 to position the abutting stem 242 of the controlling member 24. Furthermore, when the engaging member 23 extends forwardly outside the axial peg 221 of the rotating rod 22, the one end of the engaging member 23 pushes the two elastic loops 25 to expand outwardly. Thereafter, the grip 224 of the rotating rod 22 is rotated in a counterclockwise direction so that the toothed section 231 of the engaging member 23 engages with the plurality of inner teeth 213 of the tool head 21 by which the polygonal driving portion 211 of the tool head 21 is driven to rotate the bolt element 30 loosely. Thereby, in this rotary forcing mode, the abutting stem 242 of the controlling member 24 directly pushes the pushing section 232 of the engaging member 23 to make the toothed section 231 of the engaging member 23 engage with the plurality of inner teeth 213 of the tool head 21, such that the tool head 21 is driven. Furthermore, because the axial peg 221 only includes the first groove 222 defined thereon to receive one single engaging member 23, such that the axial peg 221 is reinforced to enhance the service life of the shifting device, and related connecting parts are simplified to lower production cost.

Figure 11:
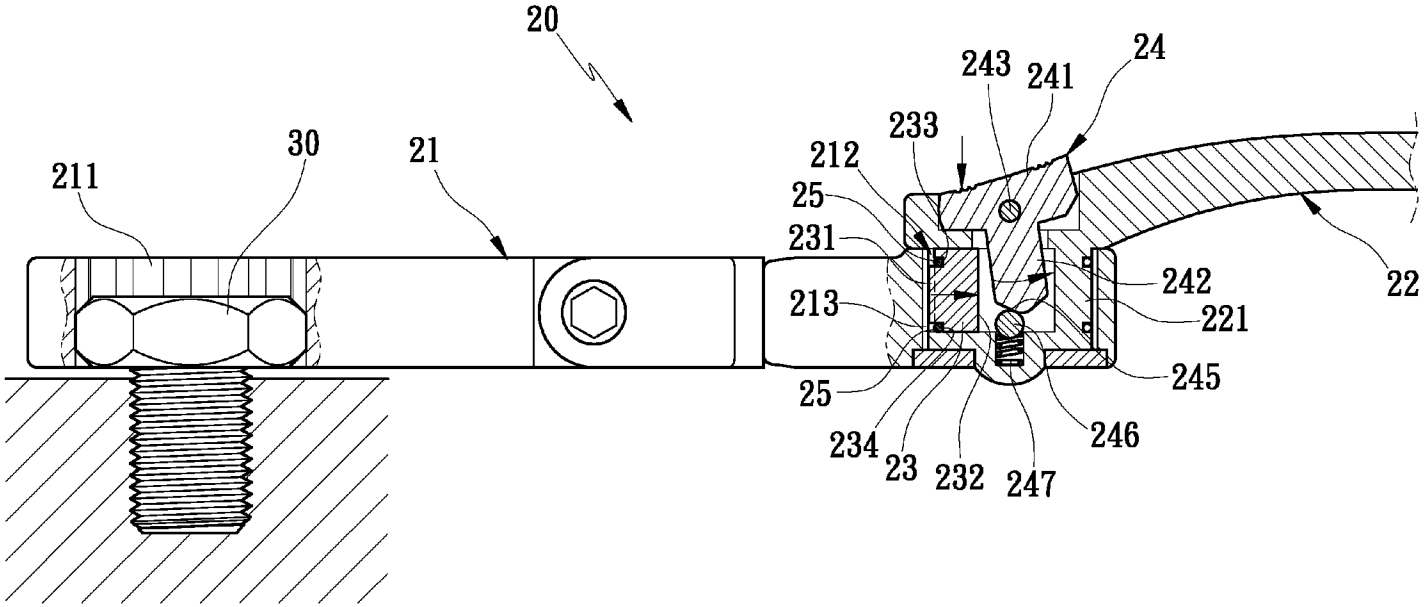
FIG. 11 is a cross sectional view showing the shifting device of the present invention is operated in a quick rotating mode.
Figure 12:
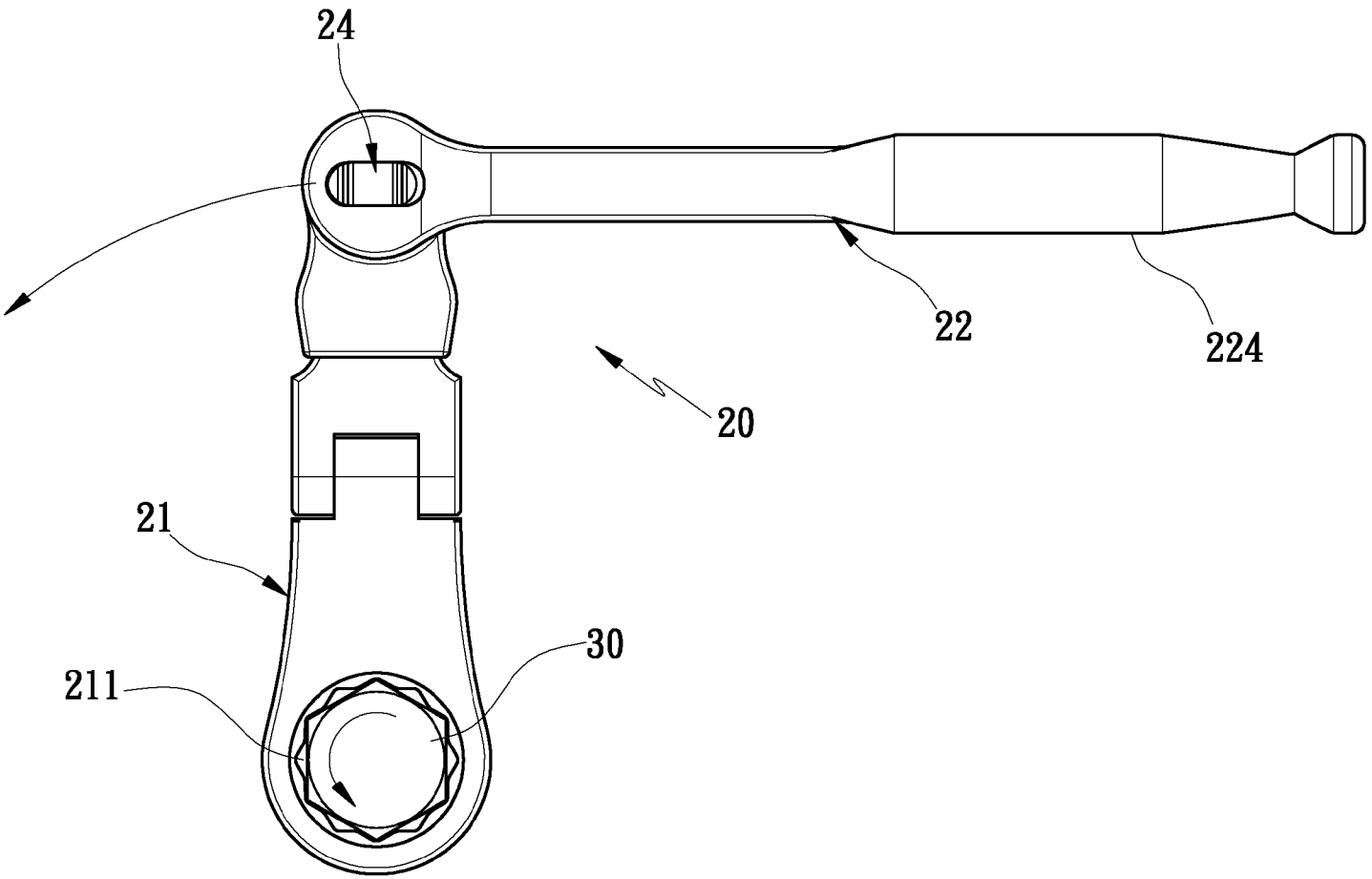
FIG. 12 is a top plan view showing the shifting device of the present invention is operated in the quick rotating mode as well.

Referring further to FIGS. 11 and 12, after rotating the bolt element 30 loosely, the wrench tool 20 is shifted to a quick rotating mode to remove the bolt element 30 rapidly, wherein a front end of the switch 241 of the controlling member 24 is pressed to control the abutting stem 242 of the controlling member 24 to move backward so that the abutting stem 242 of the controlling member 24 disengages from the pushing section 232 of the engaging member 23, and the biasing element 246 is biased against the second positioning portion 245 of the controlling member 24 to position the abutting stem 242 of the controlling member 24. After the abutting stem 242 of the controlling member 24 disengages from the pushing section 232 of the engaging member 23, the two elastic loops 25 push the one end of the engaging member 23 to move back to the original position. Thereafter, the toothed section 231 of the engaging member 23 disengages from the plurality of inner teeth 213 of the tool head 21 so that the axial peg 221 of the rotating rod 22 axially rotates in the axial hole 212 of the tool head 21 and drives the axial hole 212 to rotate quickly along the bolt element 30 in the counterclockwise direction, thereby removing the bolt element 30 in the quick rotating mode.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A shifting device for a wrench tool comprises:

a tool head including a driving portion defined on one end thereof and an axial hole defined on another end thereof, and the axial hole having a plurality of inner teeth defined around an inner surface thereof;

a rotating rod including an axial peg extending outwardly from one end thereof to be fitted in the axial hole of the tool head, and the axial peg including a first groove horizontally defined on a bottom end thereof and a second groove vertically formed on a top end thereof and communicating with the first groove;

an engaging member received in the first groove of the rotating rod and having a toothed section defined on one end thereof and a pushing section formed on another end thereof;

a controlling member fixed in the second groove of the rotating rod and having an abutting stem extending into the first groove, such that the controlling member pushes the pushing section of the engaging member so that the toothed section of the engaging member engages with the plurality of inner teeth of the tool head;

two elastic loops fitted on the axial peg of the rotating rod to push the one end of the engaging member so that the engaging member moves back to an original position.

2. The shifting device for the wrench tool as claimed in claim 1, wherein the driving portion of the tool head is a polygonal orifice.

3. The shifting device for the wrench tool as claimed in claim 1, wherein between the axial hole of the tool head and the axial peg of the rotating rod is defined a limiting structure so that the axial peg of the rotating rod is limited in the axial hole of the tool head, the limiting structure contains a stepped slot formed on an bottom end of the axial hole of the tool head and a stop ring fixed on a bottom end of the axial peg of the rotating rod so that the stepped slot of the tool head stops the stop ring to prevent the axial peg from disengagement from the axial hole.

4. The shifting device for the wrench tool as claimed in claim 1, wherein the rotating rod includes a grip arranged on another end thereof for being held by a user.

5. The shifting device for the wrench tool as claimed in claim 1, wherein the controlling member has a switch fixed on one end thereof and located at a top end of the second groove.

6. The shifting device for the wrench tool as claimed in claim 5, wherein the controlling member has a pin defined between the switch and the abutting stem and axially fixed in the second groove such that the switch drives the abutting stem to move forward and backward along the pin.

7. The shifting device for the wrench tool as claimed in claim 6, wherein the controlling member includes a positioning structure to define a front shifting position and a rear shifting position of the controlling member, the positioning structure contains a first positioning portion and a second positioning portion, both of which are defined on a bottom end of the abutting stem of the controlling member, and the positioning structure also contains a biasing element and a resilient element, both of which are mounted under the bottom end of the abutting stem, such that the resilient element pushes the biasing element so that the biasing element abuts against the first positioning portion and the second positioning portion of the controlling member.

8. The shifting device for the wrench tool as claimed in claim 1, wherein each elastic loop has an opening defined thereon so that the each elastic loop expands and retracts elastically.

9. The shifting device for the wrench tool as claimed in claim 1, wherein the axial peg of the rotating rod includes two notches defined thereon and located at an upper rim and a lower rim of the first groove so as to fit the two elastic loops.

10. The shifting device for the wrench tool as claimed in claim 9, wherein the engaging member also includes two contacting indentations formed on the one end thereof to contact with the two elastic loops.

* * * * *